US008183490B2

(12) United States Patent
Gibson et al.

(10) Patent No.: US 8,183,490 B2
(45) Date of Patent: May 22, 2012

(54) SHIELD APPARATUS FOR CIRCUIT BREAKER

(75) Inventors: Perry Robert Gibson, East Palestine, OH (US); Brian John Schaltenbrand, Pittsburgh, PA (US); Mark Anthony Janusek, Pittsburgh, PA (US); Craig Allen Rodgers, Imperial, PA (US); James Michael Smeltzer, Salem, OH (US)

(73) Assignee: Eaton Corporation, Cleveland, OH (US)

( * ) Notice: Subject to any disclaimer, the term of this patent is extended or adjusted under 35 U.S.C. 154(b) by 320 days.

(21) Appl. No.: 12/568,320

(22) Filed: Sep. 28, 2009

(65) Prior Publication Data

US 2011/0073568 A1 Mar. 31, 2011

(51) Int. Cl.
*H01H 75/00* (2006.01)

(52) U.S. Cl. ..... 218/147; 218/154

(58) Field of Classification Search ..... 218/14–21, 218/29, 30, 34–41, 147–158; 335/201
See application file for complete search history.

(56) References Cited

U.S. PATENT DOCUMENTS

| | | | | |
|---|---|---|---|---|
| 6,977,568 | B1 * | 12/2005 | Rakus et al. | 218/22 |
| 7,009,132 | B1 | 3/2006 | Shea et al. | |
| 7,358,840 | B1 | 4/2008 | Shea et al. | |
| 7,646,269 | B2 * | 1/2010 | Weister et al. | 218/22 |
| 2008/0067042 | A1 | 3/2008 | Shea et al. | |
| 2008/0218296 | A1 * | 9/2008 | Weister et al. | 335/12 |

* cited by examiner

*Primary Examiner* — Renee S Luebke
*Assistant Examiner* — Marina Fishman
(74) *Attorney, Agent, or Firm* — John A. Kastelic; Martin J. Moran

(57) ABSTRACT

An improved circuit breaker having an improved shield apparatus provides protection to components that are internal to the circuit breaker during an arc event. A contact arm carrier assembly of the circuit breaker comprises a number of springs that bias a number of movable contacts that are disposed on contact arms into engagement and electrical connection with a stationary contact. The shield apparatus is disposed on a carrier housing of the contact arm carrier assembly and is situated adjacent the springs. A shield member of the shield apparatus is biased into engagement with the contact arms. When the circuit breaker is moved between the ON position and the OFF or TRIPPED positions, the shield of the shield apparatus moves between a retracted position and a deployed position, with the shield remaining in engagement with the contact arms and protecting the springs from damage in an arc event. In one embodiment, the shield member is formed of a material that generates gases when struck by an arc.

18 Claims, 4 Drawing Sheets

SHIELD APPARATUS FOR CIRCUIT BREAKER

BACKGROUND OF THE INVENTION

1. Field of the Invention

The present invention relates to a circuit breaker and, more specifically, to a shield apparatus for protecting elements that are internal to a circuit breaker.

2. Background Information

Circuit breakers, including molded case circuit breakers, have at least one pair of separable contacts. A first contact, known as a "stationary contact", is fixed within the housing. The other contact, the "movable contact," is disposed on a movable contact arm that is a part of a contact arm carrier assembly which is coupled to an operating mechanism. Both contacts are disposed on conductive elements that are in electrical communication with either the line or load coupled to the circuit breaker. The operating mechanism is structured to move the movable contact between a first, closed position wherein the fixed and movable contacts are in contact and are electrically connected, and a second, open position wherein the movable contact is spaced from the fixed contact whereby the contacts are electrically disconnected. The operating mechanism may be operated manually or by the circuit breaker's trip mechanism. When a circuit breaker has multiple poles, each pole has its own set of separable contacts.

Each set of contacts is typically disposed within a separate contact chamber. The housing typically has a base portion, in which the majority of components are disposed, and a primary cover. The arc chamber is structured to dissipate an arc following separation of the contacts. That is, when the contacts are separated an arc may form, especially during an over-current event. The arc is dissipated in the arc chamber but the arc still creates gases and possibly a spray of molten debris. A problem typically exists due to the possibility of the blowback of arc gases and molten debris into the contact arm carrier assembly or the operating mechanism or both. The arc gases are typically vented through an exhaust. However, the molten debris and the arc gases, which may be corrosive, can impact on the contact arm carrier assembly components or the operating mechanism components or both, causing damage thereto. There is, therefore, a need to protect certain components that are internal to a circuit breaker during an arc event.

SUMMARY OF THE INVENTION

An improved circuit breaker having an improved shield apparatus provides protection to components that are internal to the circuit breaker during an arc event. A contact arm carrier assembly of the circuit breaker comprises a number of springs that bias a number of movable contacts that are disposed on contact arms into engagement and electrical connection with a stationary contact. As employed herein, the expression "a number of" and variations thereof shall refer broadly to any non-zero quantity, including a quantity of one. The shield apparatus is disposed on a carrier housing of the contact arm carrier assembly and is situated adjacent the springs. A shield of the shield apparatus is biased into engagement with the contact arms. When the circuit breaker is moved between the ON position and the OFF or TRIPPED positions, the shield of the shield apparatus moves between a retracted position and a deployed position, with the shield remaining in engagement with the contact arms and protecting the springs from damage in an arc event. In one embodiment, the shield member is formed of a material that generates gases when struck by an arc, and such gases can help to drive the arc into an arc chute of the circuit breaker.

Accordingly, an aspect of the invention is to provide an improved circuit breaker that protects certain internal components thereof in an arc event.

Another aspect of the invention is to provide an improved circuit breaker having an improved shield apparatus that is disposed on a contact arm carrier assembly of the circuit breaker and that moves therewith between an ON condition and an OFF or TRIPPED position, or both.

Another aspect of the invention is to provide an improved circuit breaker having a receptacle formed in a contact arm carrier assembly and having a shield member that is movably disposed in the receptacle and that is biased into engagement with a number of contact arms of the contact arm carrier assembly.

Another aspect of the invention is to provide an improved shield apparatus for use in a circuit breaker wherein the shield apparatus includes a shield member that is disposed adjacent certain components internal to the circuit breaker and that generates gases during an arc event to protect the components from damage during the arc event.

BRIEF DESCRIPTION OF THE DRAWINGS

A full understanding of the invention can be gained from the following Description of the Preferred Embodiments when read in conjunction with the accompanying drawings in which.

Similar numerals refer to similar parts throughout the specification.

DESCRIPTION OF THE PREFERRED EMBODIMENTS

Figure 1:
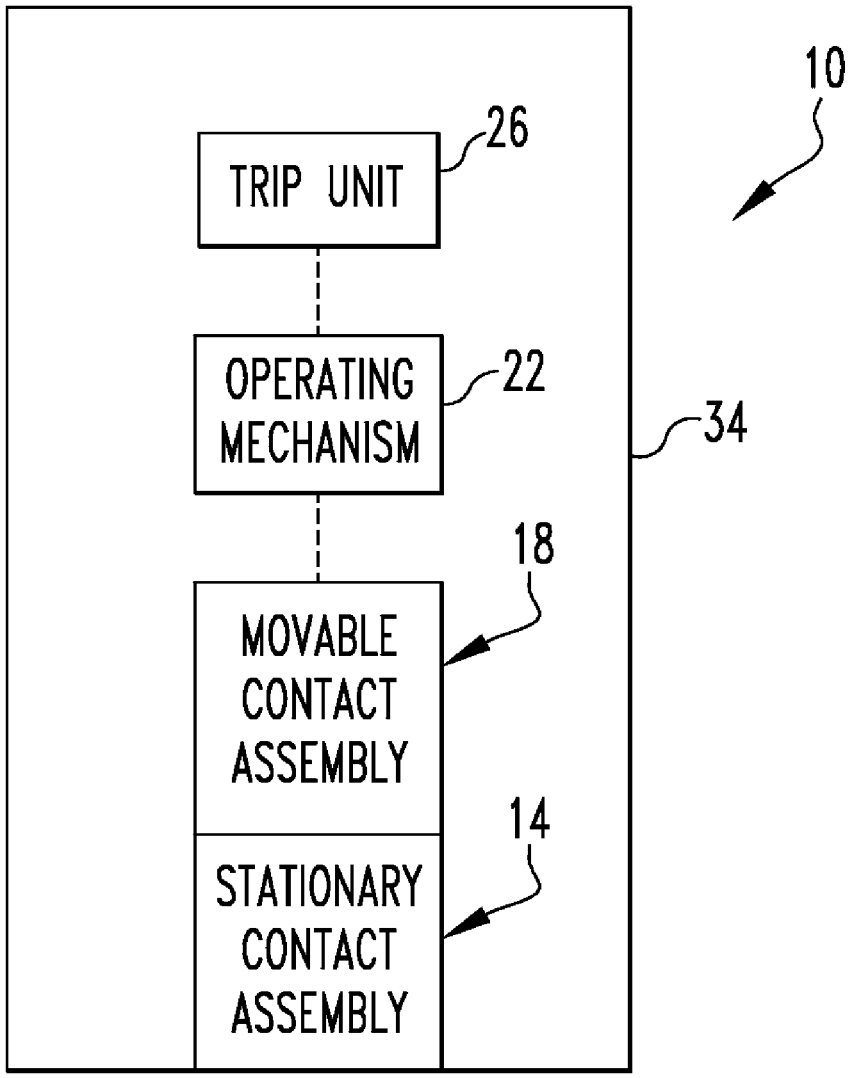
FIG. 1 is a schematic depiction of an improved circuit breaker in accordance with the invention.

An improved circuit breaker 10 is depicted in a schematic fashion in FIG. 1 and is depicted in part in FIGS. 2-5. The circuit breaker 10 is an electrical switching apparatus that is connectable with a line and a load of a circuit and that is structured to interrupt the circuit in certain predetermined events.

The circuit breaker 10 comprises a stationary contact assembly 14, a movable contact assembly 18, an operating mechanism 22, and a trip unit 26, all of which are disposed on a housing 34 of the circuit breaker 10. The housing 34 comprises a base portion 38 and a cover (not expressly shown herein). The movable contact assembly 18 is in the form of a contact arm carrier assembly and is movable with respect to the stationary contact assembly 14 between an ON operational condition, an OFF operational condition, and a TRIPPED operation condition. In the exemplary embodiment of the circuit breaker 10 depicted herein, the OFF operational condition and the TRIPPED operation condition are substantially the same.

Figure 2:
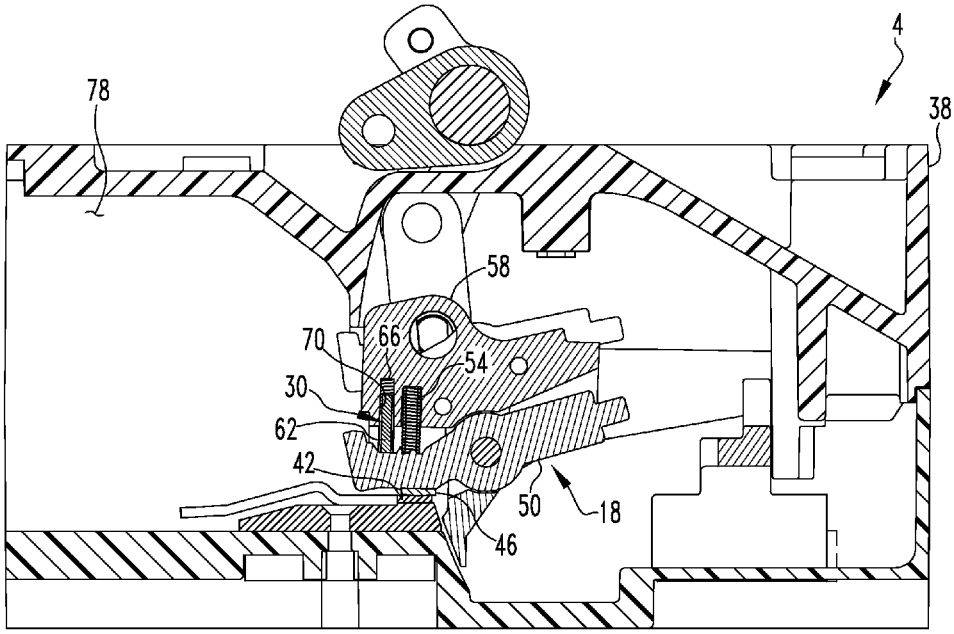
FIG. 2 is a cut away view of the circuit breaker of FIG. 1 in an ON condition.
Figure 3:
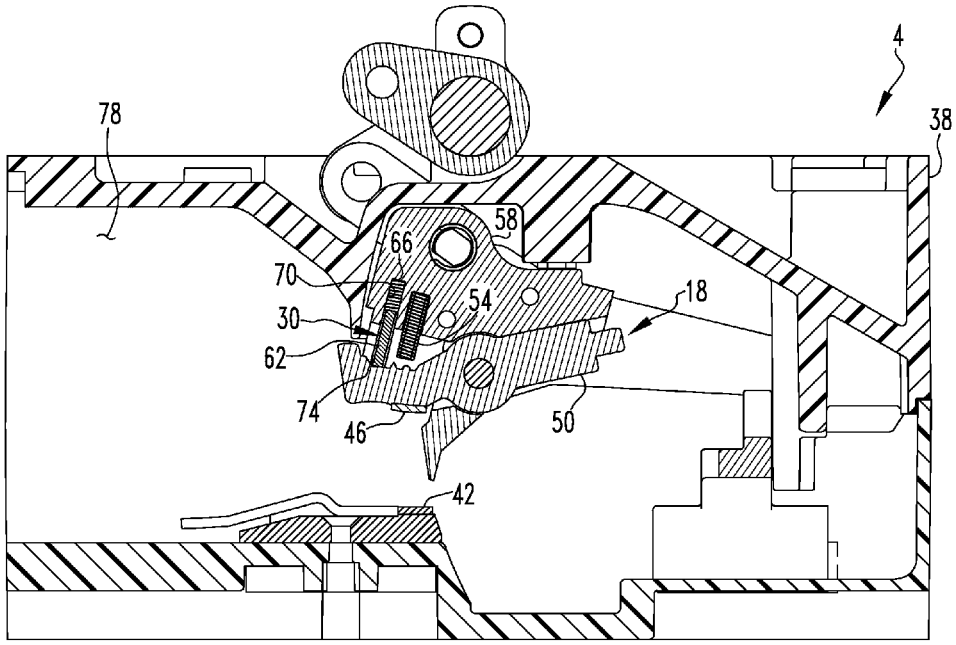
FIG. 3 is a view similar to FIG. 2, except depicting the circuit breaker in an OFF or TRIPPED position.
Figure 4:
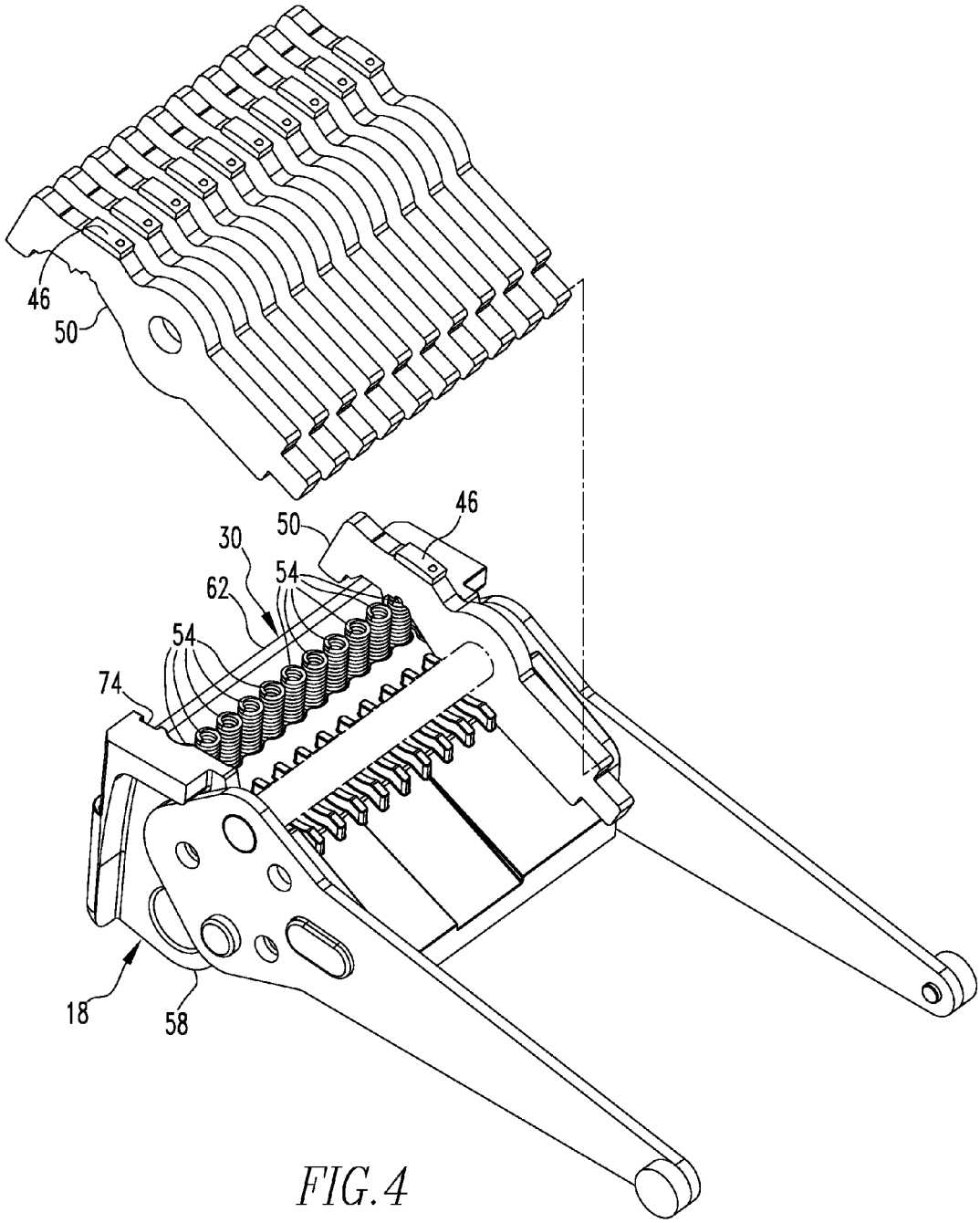
FIG. 4 is a perspective view of a portion of a contact arm carrier assembly of the circuit breaker of FIG. 1.

The movable contact assembly 18 and the operating mechanism 22 are operationally connected together. The operating mechanism 22 is structured to operate the movable contact assembly 18 between the ON, OFF, and TRIPPED operational conditions. The trip unit 26 is operationally connected with the operating mechanism 22 and serves to trigger it to cause the circuit breaker 10 to move from the ON operational condition to the OFF or TRIPPED operational conditions in over-current conditions and other conditions. The trip unit 26 may include current transformers or other structures that operate in a manner well known in the relevant art to detect current flowing through a number of stationary contacts 42 of the stationary contact assembly 14 and a number of movable contacts 46 movable contact assembly 18 when electrically connected together such as in the ON operational condition of the circuit breaker 10. The circuit breaker 10 is depicted in FIGS. 1 and 2 as being in the ON operational condition and is depicted in FIG. 3 as being in the OFF or TRIPPED operational conditions.

The movable contact assembly 18 comprises a carrier housing 58. The movable contact assembly 18 further comprises a plurality of contact arms 50, a plurality of contact arm springs 54, and a shield apparatus 30, all of which are disposed on the carrier housing 58. The contact arms 50 are connected at one end with the carrier housing 58. One of the movable contacts 46 is disposed on each contact arm near a free end thereof opposite its connection with the carrier housing 58. Although not explicitly depicted herein, each movable contact 46 is electrically connected with a shunt that is, in turn, connected with a load terminal of the circuit breaker 10.

The contact arm springs 54 are disposed on the carrier housing 58, and in the ON operational condition of the circuit breaker 10 these contact arm springs 54 bias the contact arms 50 toward the stationary contact 42, thus effectively biasing the movable contacts 46 into engagement and electrical connection with the stationary contact 42. While in the exemplary embodiment depicted herein the plurality of movable contacts 46 each engage a single, i.e., common, stationary contact 42, it is understood that other configurations are possible without departing from the present concept.

Figure 5:
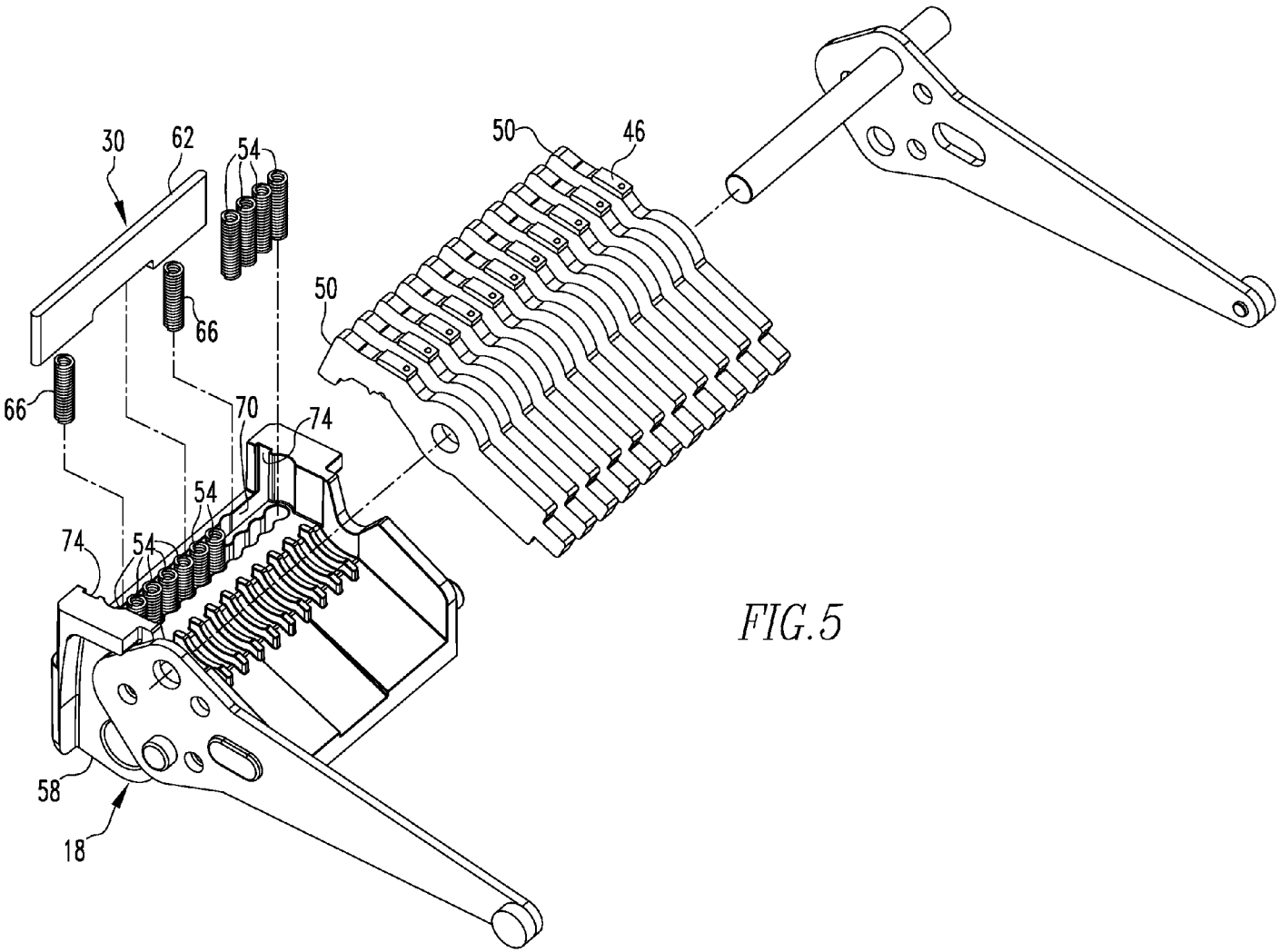
FIG. 5 is an exploded view of the portion of the contact arm carrier assembly of FIG. 4.

As can be understood from FIG. 5, the shield apparatus 30 comprises a shield member 62 and a number of shield springs 66. In the exemplary embodiment depicted herein, the quantity of shield springs 66 employed in the shield apparatus 30 is two, but it is noted that in other embodiments different quantities and configurations of structures to bias the shield member 62 may be employed without departing from the present concept. It is also noted that in some embodiments it may be possible to achieve the same benefits mentioned herein without the use of the shield springs 66.

The shield member 62 in the depicted embodiment is a plate-like parallelepiped solid structure that is configured to serve as a barrier to resist the impingement of arc gases and molten material on the contact arm springs 54 and other structures of the circuit breaker 10 during an arc event. The shield member 62 may be formed of a material that generates gases when struck by an electrical arc. Such materials are well known to those skilled in the relevant art. Also, the shield member 62 can be formed of a material that does not generate a gas in the presence of an arc without departing from the present concept.

As can be understood from FIGS. 2 and 3, the carrier housing 58 has a receptacle 70 formed therein. The shield apparatus 30 is disposed, at least in part, in the receptacle 70. The shield apparatus 30 is movable between a retracted position when the movable contact assembly 18 is in its ON operational condition, as is depicted generally in FIG. 2, and a deployed position when the movable contact assembly 18 is in the OFF or TRIPPED position, such as is depicted generally in FIG. 3. As can be understood from FIGS. 2 and 3, the shield member 62 is engaged with the contact arms 50 in the ON operational condition of FIG. 2 and in the OFF and TRIPPED operational condition of FIG. 3 and remains engaged as such at substantially at all times during movement between such operational positions. In the deployed position at least a portion of the shield member 62 remains disposed in the receptacle 70, although it is noted that a relatively greater portion of the shield member 62 is received in the receptacle 70 in the retracted position. As can be understood from FIGS. 4 and 5, the shield member 62 is slidably received in a pair of guides 74 that are formed in the carrier housing 58 and that are aligned with the receptacle 70.

As can further be understood from FIGS. 2 and 3, the shield member 62 is disposed adjacent the contact arm springs 54 in all of the operational conditions of the circuit breaker 10. Also, the shield member is disposed between the contact arm springs 54 and an arc chamber 78 of the housing 34. In the ON operational condition of the circuit breaker 10, the shield member 62 is engaged with and extends across all of the contact arms 50 of the movable contact assembly 18. The movable contact assembly 18 of each pole comprises a plurality of contact arms 50 and corresponding contact arm springs 54. It is noted that in the exemplary embodiment depicted herein the movable contact assembly 18 comprises eleven contact arms 50 and eleven corresponding contact arm springs 54, but it is noted that in other embodiments different quantities can be employed without departing from the present concept. In the ON operational condition of the circuit breaker 10, each contact arm 50 is biased toward the stationary contact 42 by a corresponding one of the contact arm springs 54. The contact arm springs 54 thus serve as biasing elements that effectively bias the movable contacts 46 into engagement and electrical connection with the stationary contact 42 when the circuit breaker 10 is in the ON operational condition.

As can further be understood from FIGS. 2 and 3, the movable contacts 46 are disposed on an underside (from the perspective of FIGS. 2 and 3) of the contact arms 50. The shield member 62 and the contact arm springs 54 each engage the contact arms 50 at an upper side (again from the perspective of FIGS. 2 and 3), which is on a surface of the contact arms 50 opposite that on which the movable contacts 46 are situated.

In certain circumstances, such as in an over-current condition, trip unit 26 triggers the operating mechanism 22 to move the circuit breaker 10 from the ON operational condition of FIG. 2 to the OFF or TRIPPED operational condition of FIG. 3. In such a situation, an arc (not expressly depicted herein) might be generated between the stationary contact 42 and one or more of the movable contacts 46 at the moment of separation. Such an arc will move leftward (from the perspective of FIGS. 2 and 3) into the arc chamber 78 where the arc ultimately is extinguished. However, prior to the complete extinguishment of the arc, the arc might generate arc gases and/or a plasma of molten materials which, if deposited on certain elements within the interior of the circuit breaker 10, may cause damage thereto. Advantageously, therefore, the shield apparatus 30 is provided to resist the flow of arc gases, molten material, and the like from the arc chamber 78 toward the contact arm springs 54. In this regard, it is noted that in the deployed condition the shield member 62 is disposed at least in part in the receptacle 70, is received in the guides 74, and is engaged with the upper sides (from the perspective of FIGS. 2 and 3) of the contact arms 50. Such reception of the shield member 62 in the receptacle 70 and the guides 74 and the engagement of the shield member 62 with the contact arms 50 serve to provide a barrier to resist the flow of arc gases and molten material from the arc chamber 78 around the shield member 62 and toward the contact arm springs 54, and thereby protects the contact arm springs 54 from damage in an arc event. It is understood that other structures internal to the circuit breaker can be protected in such a fashion.

It is noted that the continued engagement of the shield member 62 with the contact arms 50 during movement between the ON operational condition and the OFF or TRIPPED operational conditions protects the contact arm springs 54 from arc gases and molten material at all times during movement of the movable contact assembly 18 between such operational conditions, which protects the contact arm springs 54 from damage in an arc event. Such continued engagement of the shield member 62 with the contact arms 50 is provided by the shield springs 66 which are biasing members that bias the shield member 62 in a direction from the carrier housing 58 toward the contact arms 50. It also can be seen that the shield springs 62 bias the shield member 62 toward the deployed position.

It therefore can be seen that the advantageous shield apparatus 30 and the advantageous circuit breaker 10 protect the contact arm springs 54 from damage due to arc gases and molten debris in an arc event. If the shield member 62 generates gases in the presence of an arc, the gases will tend to push the arc gases and thus the molten material toward the arc chamber 78 for extinguishment, thus further protecting the contact arm springs 54.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A shield apparatus for use in an electrical switching apparatus that comprises a stationary contact assembly and a movable contact assembly, the stationary contact assembly comprising a number of stationary contacts, the movable contact assembly comprising a number of movable contacts, a number of contact arms, a number of biasing elements, and a carrier housing, the number of movable contacts being disposed on the number of contact arms, the number of contact arms being disposed on the carrier housing, the movable contact assembly being movable between a first operational condition in which the number of stationary contacts and the number of movable contacts are electrically connected and a second operational condition in which the number of stationary contacts and the number of movable contacts are electrically disconnected, in the first operational condition the number of biasing elements biasing the number of contact arms away from the housing and toward the number of stationary contacts, the shield apparatus comprising:

a plate-like shield member structured to be movable with respect to the carrier housing and to protect the number of biasing elements from damage due to an arc event.

2. The shield apparatus of claim 1 wherein the number of biasing elements extend between the carrier housing and the number of contact arms, and wherein the shield member is structured to be disposed on the carrier housing.

3. The shield apparatus of claim 1 wherein the shield member is structured to extend between the carrier housing and the number of contact arms.

4. The shield apparatus of claim 1 wherein the carrier housing has a receptacle formed therein, at least a portion of the shield being structured to be received in the receptacle.

5. The shield apparatus of claim 4 wherein the shield member is structured to be movable between a retracted position and a deployed position, the shield member being structured to be in the retracted position when the movable contact assembly is in the first operational condition, the shield member being structured to be in the deployed position when the movable contact assembly is in the second operational condition, and at least a portion of the shield being structured to be received in the receptacle in both the retracted and deployed positions.

6. The shield apparatus of claim 4 wherein the carrier housing comprises a number of guides aligned with the receptacle, at least a portion of the shield being structured to be movably disposed in the number of guides.

7. The shield apparatus of claim 2 wherein the shield apparatus further comprises a number of biasing members that are structured to bias the shield into engagement with the number of contact arms.

8. The shield apparatus of claim 7 wherein the shield is structured to remain engaged with the number of contact arms during movement of the movable contact assembly between the first and second operational conditions.

9. The shield apparatus of claim 1 wherein the shield is formed of a material that is structured to generate gas in the presence of an arc of an arc event.

10. An electrical switching apparatus comprising:

a housing;

a stationary contact assembly disposed on the housing and comprising a number of stationary contacts;

a movable contact assembly disposed on the housing and comprising a number of movable contacts, a number of contact arms, a number of biasing elements, and a carrier housing;

the number of movable contacts being disposed on the number of contact arms;

the number of contact arms being disposed on the carrier housing;

the movable contact assembly being movable between a first operational condition in which the number of stationary contacts and the number of movable contacts are electrically connected and a second operational condition in which the number of stationary contacts and the number of movable contacts are electrically disconnected;

in the first operational condition the number of biasing elements biasing the number of contact arms away from the housing and toward the number of stationary contacts; and a shield apparatus that comprises a plate-like shield member movable with respect to the carrier housing and structured to protect the number of biasing elements from damage due to an arc event.

11. The electrical switching apparatus of claim 10 wherein the shield member is disposed on the carrier housing and wherein the number of biasing elements extend between the carrier housing and the number of contact arms.

12. The electrical switching apparatus of claim 10 wherein the shield member extends between the carrier housing and the number of contact arms.

13. The electrical switching apparatus of claim 10 wherein the carrier housing has a receptacle formed therein, at least a portion of the shield being received in the receptacle.

14. The electrical switching apparatus of claim 13 wherein the shield member is movable between a retracted position and a deployed position, the shield member being in the retracted position when the movable contact assembly is in the first operational condition, the shield member being in the deployed position when the movable contact assembly is in the second operational condition, and at least a portion of the shield being received in the receptacle in both the retracted and deployed positions.

15. The electrical switching apparatus of claim 13 wherein the carrier housing comprises a number of guides aligned with the receptacle, at least a portion of the shield being movably disposed in the number of guides.

16. The electrical switching apparatus of claim 11 wherein the shield apparatus further comprises a number of biasing members that bias the shield into engagement with the number of contact arms.

17. The electrical switching apparatus of claim 16 wherein the shield remains engaged with the number of contact arms during movement of the movable contact assembly between the first and second operational conditions.

18. The electrical switching apparatus of claim 10 wherein the shield is formed of a material that is structured to generate gas in the presence of an arc of an arc event.

* * * * *